United States Patent [19]

Zimmermann et al.

[11] Patent Number: 4,726,097

[45] Date of Patent: Feb. 23, 1988

[54] APPARATUS FOR COILING SLIVER OR ROVING IN A SPINNING CAN

[75] Inventors: Bernhard Zimmermann, Ebersbach; Siegfried Günkinger, Heiningen, both of Fed. Rep. of Germany

[73] Assignee: Zinser Textilmaschinen GmbH, Ebersbach, Fed. Rep. of Germany

[21] Appl. No.: 2,136

[22] Filed: Jan. 12, 1987

[30] Foreign Application Priority Data

Jan. 10, 1986 [DE] Fed. Rep. of Germany ..... 3600508

[51] Int. Cl.[4] ..... B65H 54/80

[52] U.S. Cl. ..... 19/159 R

[58] Field of Search ..... 19/159 R, 159 A

[56] References Cited

U.S. PATENT DOCUMENTS

| | | | |
|---|---|---|---|
| 3,638,278 | 2/1972 | Johnels | 19/159 R |
| 3,938,222 | 2/1976 | Garrison | 19/159 R |
| 4,646,390 | 3/1987 | Bother | 19/159 R |

*Primary Examiner*—Louis K. Rimrodt

*Attorney, Agent, or Firm*—Karl F. Ross; Herbert Dubno

[57] ABSTRACT

The apparatus which coils a plurality of turns of sliver or roving for example from a spinning machine in a spinning can comprises a coiler plate having an outlet yarn piece guide. To equalize the deposition density of the sliver or roving an oscillatory motion is superimposed on the motion of the outlet sliver guide of the coiler plate caused by the rotation of the coiler plate.

20 Claims, 13 Drawing Figures

FIG.1
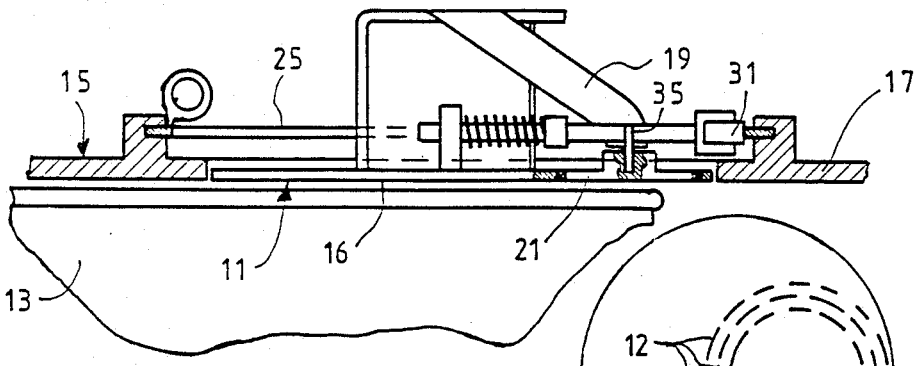
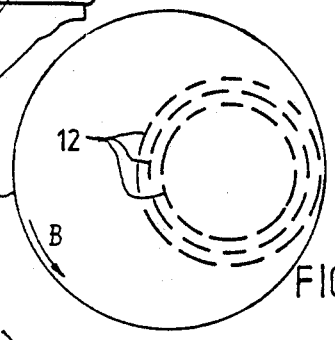
FIG.7A
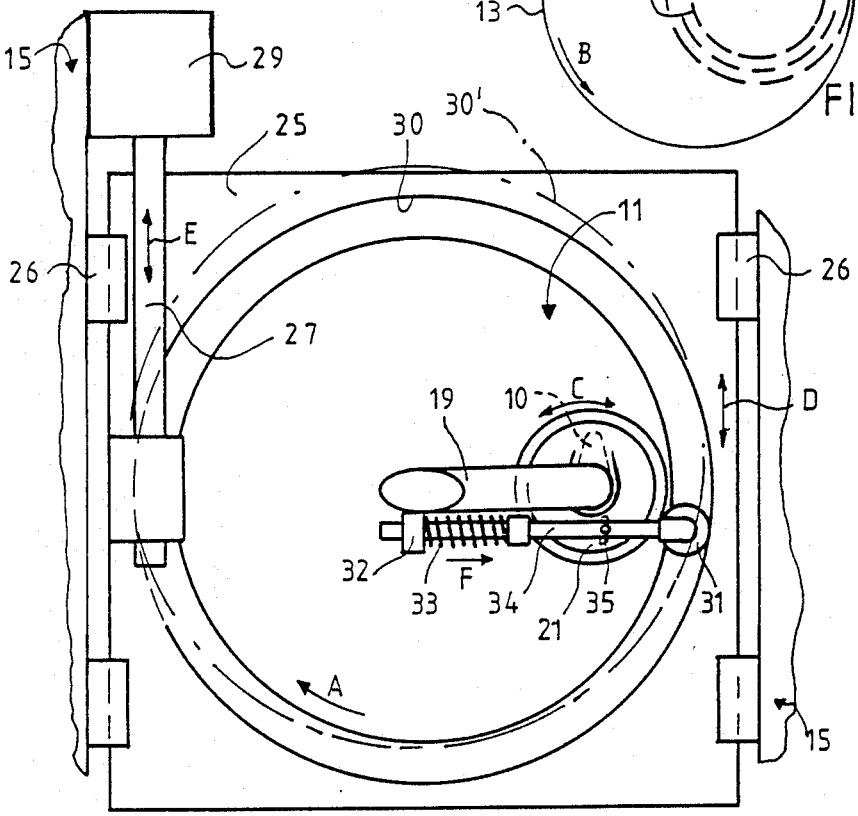
FIG.2

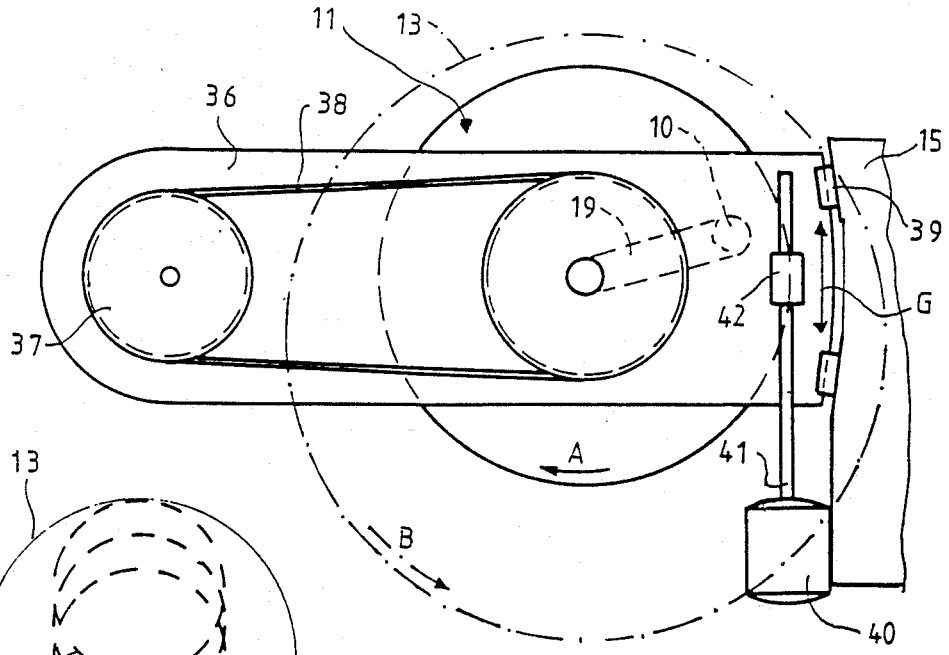
FIG.6
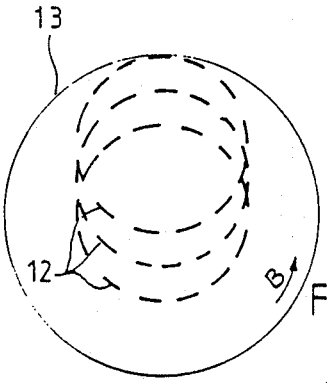
FIG.3
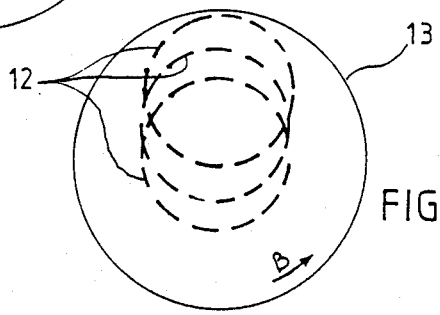
FIG.7
FIG.5
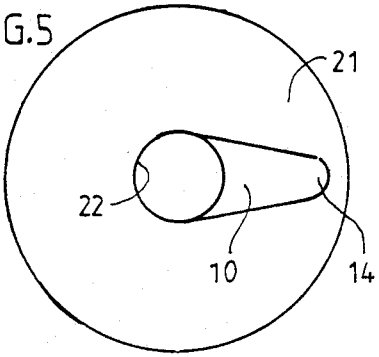
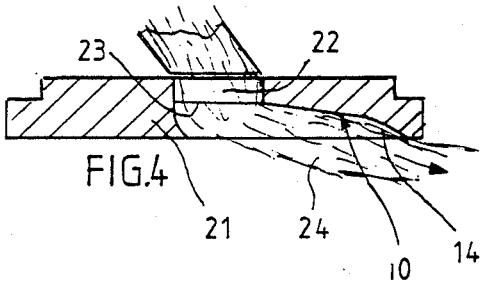
FIG.4

APPARATUS FOR COILING SLIVER OR ROVING IN A SPINNING CAN

FIELD OF THE INVENTION

Our present invention relates to an apparatus for coiling sliver or roving in a spinning can.

BACKGROUND OF THE INVENTION

A coiler or like apparatus puts sliver or roving supplied by a carding machine, a set of drafting rolls, a combing machine and other spinning machines into spinning cans. The deposition of the sliver or roving occurs in cycloidal turns. There are two alternatives in practice. Either the coiler plate (turntable) is rotated about a fixed rotation axis and the spinning can performs a slow rotational motion about its longitudinal axis in a direction opposite to that of the coiler plate or the spinning can stands still and the rotation axis of the spinning can is slowly moved about the longitudinal axis of the spinning can during the more rapid rotation of the coiler plate.

The deposition density of the sliver or roving in the spinning can has not been known to be kept constant throughout the can in such systems.

Further, in the vicinity of the longitudinal axis of the spinning can and the inner periphery of the spinning can more sliver or roving per unit volume are usually laid in than in the ring shaped central region found between these regions concentric to each other. The consequence is that the sliver or roving turns can be pressed together nonuniformly in the spinning can. This can effect the homogeneity and the friction of the sliver or roving on the coiler plate disadvantageously. Also the can capacity is not used completely.

OBJECTS OF THE INVENTION

It is an object of our invention to provide an improved apparatus for coiling sliver or roving in a spinning can which obviates these drawbacks.

It is also an object of our invention to provide an improved apparatus for coiling sliver or roving in a spinning can with which a comparatively more spatially uniform deposition density of sliver or roving in the spinning can is attained than has previously been possible.

SUMMARY OF THE INVENTION

These objects and others which will become more readily apparent hereinafter are attained in accordance with our invention in an apparatus for coiling sliver or roving in a spinning can comprising a rotatable coiler plate or turntable having an outlet sliver guide.

According to our invention an oscillatory motion equalizing the deposition density of the sliver or roving is superimposed on the motion of the outlet sliver guide of the coiler plate caused by the rotation of the coiler plate.

Since an oscillatory motion equalizing the deposition density of the sliver or roving is superimposed on the motion of the outlet sliver guide of the coiler plate caused by the rotation of the coiler plate, a correspondingly more uniform deposition density of the sliver or roving results than would occur without this oscillatory motion. This improves the deposition of sliver or roving in the can and allows more sliver or roving to be coiled in the can since the deposition density in the central region of the spinning can is increased.

The superimposed oscillatory motion can advantageously run in an approximately radial direction in regard to the rotation axis of the coiler plate. Its length can advantageously amount to approximately 0.2 to 0.5 times the interior radius of the spinning can.

The outlet sliver guide of the coiler plate can be formed by a mouth, advantageously a circular mouth, of a passage or it can advantageously be formed by an elongated recess on the bottom side of a disk mounted in a circular opening in the coiler plate which extends in the rotation direction of the coiler plate and a passage for the sliver from the top of the disk which connects to that recess since this latter structure provides a particularly good lateral guiding of the sliver or roving in the superimposed oscillatory motion.

In one embodiment of our invention the outlet sliver guide of the coiler plate is movable relative to the coiler plate and during rotation of the coiler plate is driven in an oscillatory motion. This may be realized with comparatively simple structure and may attain an optimum practical uniform deposition density of the sliver or roving in the spinning cans. It is particularly advantageous when the outlet sliver guide is drivable in a swinging motion relative to said coiler plate.

According to another feature of the invention, the coiler plate is pivotally mounted on a supporting member drivable in an oscillatory motion. By this oscillatory motion of the supporting member again the deposition density of the sliver or roving in the spinning cans is equalized. This supporting member can perform linearly guided oscillatory motions or swinging motion or other suitable motions, for example two dimensional motions.

The oscillatory motions superimposed on the rotation of the coiler plate of the outlet sliver guide are so arranged that they run substantially in the radial direction with respect to the rotation axis of the coiler plate or at least have a substantial component in this radial direction.

According to a feature of the invention the outlet sliver guide is drivable relative to the coiler plate in a linearly guided oscillatory motion whose motion direction is approximately radial from the pivot axis of the coiler plate.

The oscillatory motion of the outlet sliver guide superimposed on the rotation of the coiler plate can be effected in many cases suitably by action of its own guide drive which is independent of the drive of the coiler plate.

According to a feature of the invention the superimposed oscillating motion is effected with a frequency which is different from the rotation frequency of the coiler plate.

One other possibility is that the oscillatory motion of the outer sliver guide superimposed on the rotation of the coiler plate is effected similarly by its own guide drive but this drive is in constant connection to the drive of the coiler plate in a predetermined way, for example the ratio of the rotation frequency of the coiler plate to the frequency of the superimposed oscillating motion can be in a predetermined constant ratio which is 1:1 or in fact some other ratio.

In a particularly advantageous embodiment the oscillatory motion of the outlet sliver guide superimposed on the rotation of the coiler plate is effected by a drive unit mounted on the coiler plate which is driven by rotation of the coiler plate. Thereby both the rotation of the coiler plate and the superimposed motion of the outlet sliver guide are derived from the same drive, namely the drive of the coiler plate, which may be accomplished structurally simply and and economically.

The drive unit can be driven by a suitable motor which can be mounted rigidly or on the coiler plate.

The drive mounted on the coiler plate can advantageously be provided with a crank drive, a rotary or orbital crank drive or a twin crank drive.

When the outlet sliver guide is drivable in a swinging motion relative to the coiler plate it is also advantageous that the outlet sliver guide be provided by a disk mounted pivotally about a pivot axis parallel to the central pivot axis of the coiler plate.

Further this disk may be pivoted by a cam gear whose cam is drivable in an oscillating motion relative to the coiler plate. This cam can be circular and is mountable on a linearly moving oscillating supporting member. It can be engaged by a contacting roller attached to a supporting member which can be spring loaded.

BRIEF DESCRIPTION OF THE DRAWING

The above and other objects, features and advantages of our invention will become more readily apparent from the following description, reference being made to the accompanying highly diagrammatic drawing in which:

FIG. 1 is a partially cutaway schematic side cross sectional view of an apparatus for coiling sliver or roving in a spinning can according to one embodiment of our invention;

FIG. 2 is a cutaway top view of the apparatus according to FIG. 1 in which only a part of the frame is shown;

FIG. 3 is a schematic illustration showing different rotation circles of the outlet sliver guide of the coiler plate of our invention according to FIGS. 1 and 2 coaxial to each other;

FIG. 4 is a cross sectional view through a disk in the embodiment of our invention shown in FIGS. 1 and 2, but drawn to a larger scale;

FIG. 5 is a reduced-scale bottom plan view of the disk of FIG. 4;

FIG. 6 is a partially cutaway top plan view of an apparatus for coiling sliver or roving in a spinning can according to another embodiment of our invention;

FIGS. 7 and 7A are illustrations showing several rotation circles of the outlet sliver guide of the coiler plate of the embodiments of our apparatus as shown in FIGS. 6 and/or 9;

SPECIFIC DESCRIPTION

Figure 8:
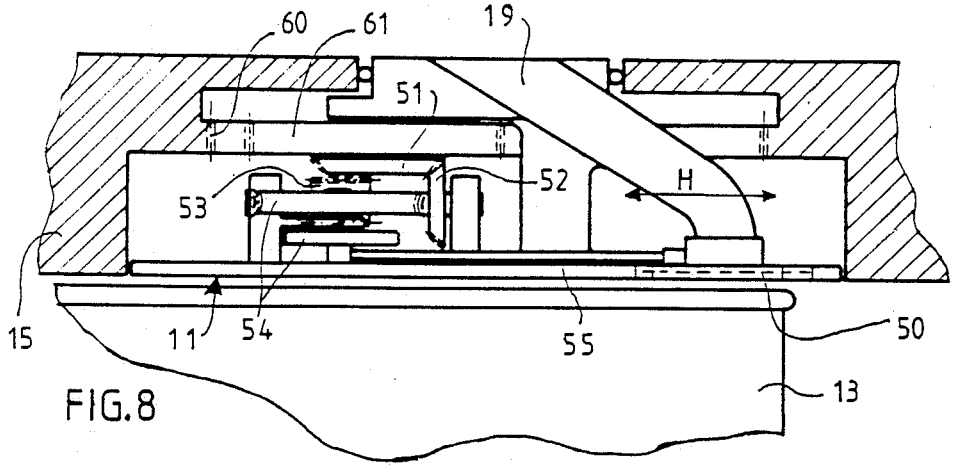
FIG. 8 is a partially cutaway side cross sectional view of yet another embodiment of our apparatus for coiling sliver or roving in a spinning can.

FIGS. 3, 7, 7A, and 11 illustrate, by way of example, both extreme and central rotation circles or sliver deposition turns formed when the sliver runs through the rear (in the rotation direction of the coiler plate 11) end 14 of the outlet sliver guide 10 during rotation of the coiler plate 11 with the oscillatory motion superimposed on it.

The transitions between these rotation circles can advantageously be continuous, i.e. instead of these rotation circles a spiral pattern can exist, which runs between both extreme rotation circles.

In FIGS. 3, 7, 7A, and 11 the spinning cans 13 are also indicated and rotate much slower (arrow A) during the rapid rotation of the coiler plate 11 about its longitudinal axis, advantageously in the opposite direction as the rotation of the coiler plate 11 which is indicated by the arrow B.

In the embodiment according to FIG. 1 a coiler plate 11 is mounted over the upper end of the cylindrical spinning can 13 with a cylindrical peripheral wall standing on a rotatably driven can plate on which a spring loaded height adjustable base is usually mounted (not shown).

This coiler plate 11 is rotatably mounted in a spatially fixed frame (like spectacle glasses) 15 rotatable about its fixed vertical rotation axis. The substantially planar lower side 16 of this coiler plate 11 aligns with the lower side of a plate 17 of the frame 15 in whose opening it is positioned. This coiler plate 11 carries a feed tube 19 inclined downwardly from its longitudinal center for a sliver fed to it from a spinning machine (not shown).

This feed tube 19 ends with a small clearance above a disk 21 more precisely shown in FIGS. 4 and 5, which is pivotally mounted with its axis parallel to the vertical pivot axis of the coiler plate 11.

The feed tube 19 ends directly over a central circular short vertical sliver feed duct 22 whose outlet mouth 23 in the roof of a lower elongated recess 10 leads into the disk 21. This recess 10 is tapered in its height and width from the front end of it in the rotation direction of the coiler plate 11 where the mouth 23 is found opposite the rotation direction of the coiler plate 11 and provides the outer sliver guide 10 of this coiler plate 11. This recess 10 forming a groove feeds the sliver 24 (FIG. 4) to its lower end 14 in which it guides the sliver laterally.

When the disk 21 is pivoted in the direction of the twin arrow C in an oscillating pivot motion this elongated recess 10 pivots correspondingly about the longitudinal center axis of the disk 21 and the longitudinal center axis of the feed duct 22 aligns with it so that the sliver 24 at the end 14 is guided to and fro transverse to the rotation direction of the coiler plate 11 laterally. Of course this lateral motion is effected between both extreme rotation circles as indicated in FIG. 3 in a spiral course.

These rotation circles of the end 14 of the sliver guide 10 are obtained only by pivoting the disk 21 according to the double arrows C and not by displacement of the feed duct 22 of the disk 21.

Thus the packing density of the sliver or roving coiled in the spinning can by this apparatus in substantially cycloidal loops is equalized over the radius of the spinning can 13.

The oscillating motion of the disk 21 is effected as follows: In the frame 15 a square plate 25 is mounted by linear guides 26 guided linearly slidable in the direction of the double arrows D. On this plate 25 a drive rod 27 is mounted which can be driven by a guide drive 29 comprising a piston cylinder to oscillate the plate 25 to and fro in the direction of the double arrows E.

In this plate a large central opening 30 is provided whose round edges form a cam on which a pivotally mounted contacting roller 31 on a mounting rod 34 is pressed because the mounting rod 34 is slidably linearly mounted and guided in a linear guide 32 attached to the coiler plate 11 and is spring loaded by a spring 33 in the direction of the arrow F.

On this mounting rod 34 a catch 35 is mounted for the disk 21 which engages in a radially elongated hole provided in the disk 21 and it can be swung to and fro in a corresponding to and fro motion of the mounting rod 34.

This to and fro motion of the mounting rod 34 can be obtained on rotation of the coiler plate 11 because the plate 25 is moved back and forth in the direction of the double arrows D by its guide drive 29 against which the position of the rotation axis of the coiler plate 11 does not change.

When the plate 25 for example is in a position in which the edge 30 is at the position 30' then the sliver is coiled on a circularlike path in a rotation of the coiler plate 11. By oscillatory movement of the plate 25 the deposition density of the sliver or roving coiled in the spinning can be comparatively uniform.

By control of the oscillation of the disk 21 also a great variety of other deposition curves for the sliver or roving may be obtained. It is also possible to drive the plate 25 in a nonlinear motion and/or with a variety of speeds in a predetermined way so that temporary stoppages can be provided and the storage density can likewise be maintained uniform. As a consequence of slow rotation of the can 13 deposition of the sliver or roving is effected in a substantially cycloidal spiral. This allows a constant deposition or storage density to be obtained.

In the embodiment according to FIG. 6 the coiler plate 11 driven rotatably is pivotably mounted on its vertical rotation axis perpendicular to the plane of the drawing on a supporting member 36 advantageously comprising a supporting arm acting as a support and is driven by a drive gear 37 by an endless belt or tension means 38. The drive gear 37 rotates about a pivot axis coaxial with the pivot axis of the supporting member 36 and is driven in an unshown way.

The coiler plate 11 is of the usual form and has as has been mentioned a feed tube 19 which feeds the sliver to the outlet sliver guide 10 which is here the outlet mouth of the feed tube 19.

The supporting member 36 is mounted pivotally on a fixed frame, guides 39 being provided at its free end for the pivotal motion.

On frame 15 a guide drive 40 comprising a drive motor for oscillatory swinging of the supporting member 36 in the directions indicated by the double arrow G is provided. This guide drive 40 is in this embodiment an electric motor which drives a threaded spindle alternately clockwise and counter clockwise which meshes with the inner threads of a threaded sleeve 42 which is attached pivotally to the supporting member 36. During the rotation of the coiler plate 11 and the advantageously oppositely rotating much slower spinning can 13 the supporting member 36 is advantageously continuously moved to and fro in the direction of the double arrow G and thereby moves the rotation circle 12 having constant radius of the outlet sliver guide 10 of the coiler plate 11 between the lowermost and uppermost rotation circle 12.

In FIG. 7 a central rotation circle 12 is indicated. Because of that the deposition density of the sliver or roving in the spinning can 13 is comparatively uniform.

Figure 9:
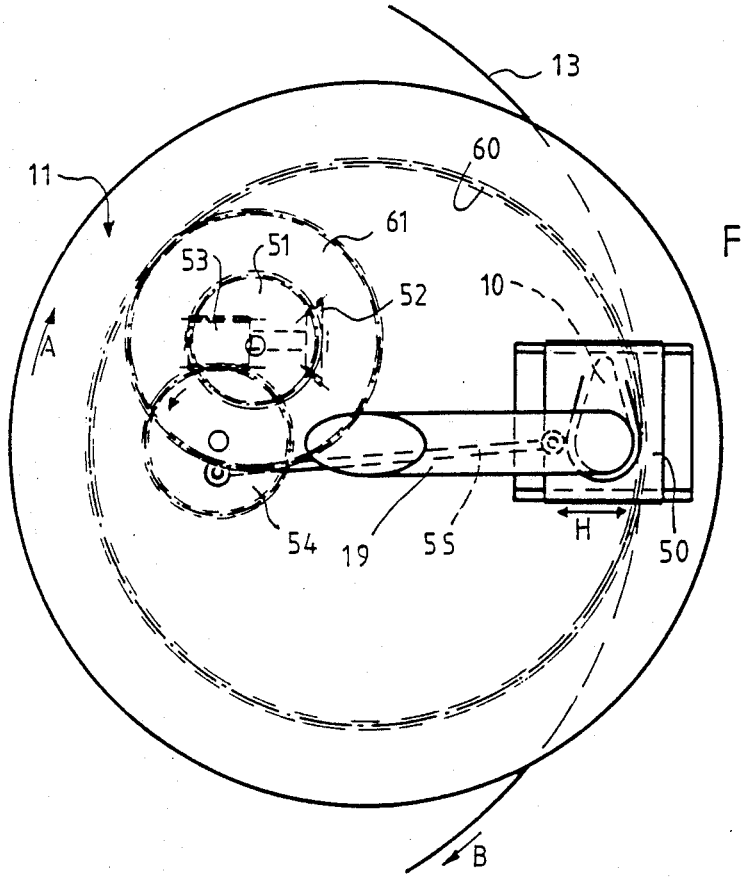
FIG. 9 is a schematic top view of the coiler plate of our invention according to FIG. 8, wherein an upper portion of the coiler plate is removed for better examination of the drive.

In the embodiment according FIGS. 8 and 9 the coiler plate 11 is pivotally mounted in a fixed frame and is driven by a drive (not shown) at a uniform rotation speed. The spinning can 13 is again driven a can plate continuously at a slow rotation rate. The sliver feed tube 19 for the sliver coiled in the spinning can 13 is found on the coiler plate 11. This sliver again is fed from a part of a spinning machine.

This feed tube 19 is held with its lower end in a carriage 50 mounted slidably in a radial direction guided linearly on the coiler plate 11 and thus at least the lower end of the sliver tube is movable to and fro with the carriage 50 in the radial direction (double arrow H).

This feed tube 19 can be flexible or entirely rigid or movable back and forth in its entirety. The back and forth motion of the carriage 50 having the outlet sliver guide 10 need only run slowly but can also occur quickly.

By the oscillating motion of the carriage 50 and with it the outer sliver guide 10 compared to the coiler plate 11 the sliver runs from the coiler plate in a spiral shape between the extreme rotation circles 12 shown in FIG. 7A which are concentric to each other and thus likewise the deposition density is equalized.

The oscillating motion of the carriage 50 is provided by a crank gear which obtains its driving force by rotation of the coiler plate 11.

For this purpose the supporting member 15' of the frame 15 has fixed inner gear teeth 60 coaxial to the rotation axis of the coiler plate 11 with which a pinion or bevel gear 61 pivotally mounted about a vertical rotation axis meshes. On this pinion gear 61 a bevel gear 51 is rigidly mounted which meshes with a second bevel gear 52 positioned at right angles to it which is pivotally mounted in a support block mounted on the coiler plate 11.

A screw 53 is attached with this second bevel gear 52 nonrotatably and coaxially which meshes with a gear 54 mounted on the coiler plate 11 pivotable about a vertical pivot axis. On this toothed gear 54 one end of a crank rod 55 is eccentrically pivotally mounted, the other end being pivotally attached to the carriage 50.

When the coiler plate 11 rotates, its rotation is converted into an advantageously slow rotational motion of the toothed gear 54 and with it a corresponding oscillatory motion of the carriage 50. Other ratios of the rotation frequency of the coiler plate to the frequency of the carriage oscillation can also be provided.

Figure 10:
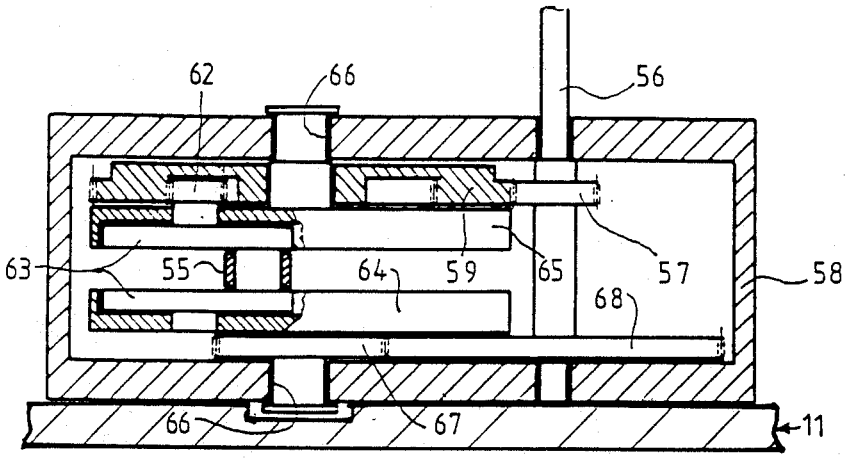
FIG. 10 is a partial cross sectional view through a coiler plate with a rotary crank gear which can take the place of the crank gear in FIGS. 8 and 9.

In the embodiment according to FIG. 10 a rotary crank gear is shown which can be used instead of the crank gear according to FIGS. 8 and 9. It is attached with its housing 58 on the coiler plate 11.

An input shaft 56 of this rotary crank gear can for example correspond to the shaft of the pinion 61 of the embodiment of FIGS. 8 and 9, thus likewise can carry a pinion (not shown) which meshes with fixed stationary inner gear teeth of the frame supporting the coiler plate. On this shaft 56 a gear 57 is mounted which meshes with a larger gear 59 which is pivotally mounted in the housing 58. This larger gear 59 has fixed inner teeth in a lower circumferential groove with which a pinion 62 meshes which is positioned concentric to a crank shaft 63 which is pivotally mounted on two disks 64,65 parallel to each other, which are pivotally mounted in two pivot bearings 66 coaxial to each other. The gear 59 is pivotally mounted on the shaft of the upper disk 65.

The lower disk 64 is attached nonrotatably to a gear 67 which is driven by a larger gear 68 which is mounted rigidly on the shaft 56. When the shaft 56 rotates it drives both disks 64, 65 by the gears 67, 68 which guide the crank shaft 63 which as a result of the pinion 62 attached nonrotatably to it is driven by the inner gearing of the gear 59 and the crank rod 55 moves correspondingly to and fro so that a carriage corresponding to the carriage 50 of FIGS. 8 and 9 which is not shown here is driven in an oscillatory motion whereby again the deposition density of the sliver or roving is equalized in the spinning can.

Figure 11:
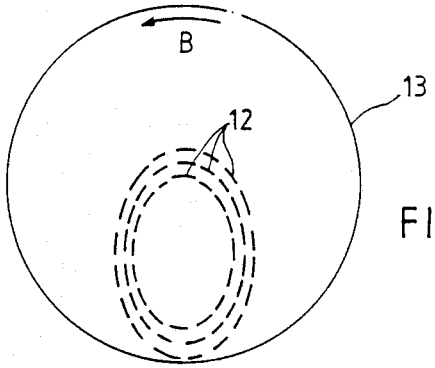
FIG. 11 is a schematic view of the rotation circles of the outlet sliver guide of the coiler plate according to FIG. 10 as are attainable for example with the rotary crank gear.

This rotary crank drive allows for example the motion of the outlet sliver guide 10 as shown in FIG. 11, i.e. elliptical or oval rotation pieces 12, whereby the effective rotation piece runs between the innermost and the outermost ellipse on a spiral course. Also other rotation courses or paths are realizable with this drive which similarly provides a uniform deposition density in the spinning can.

Figure 12:
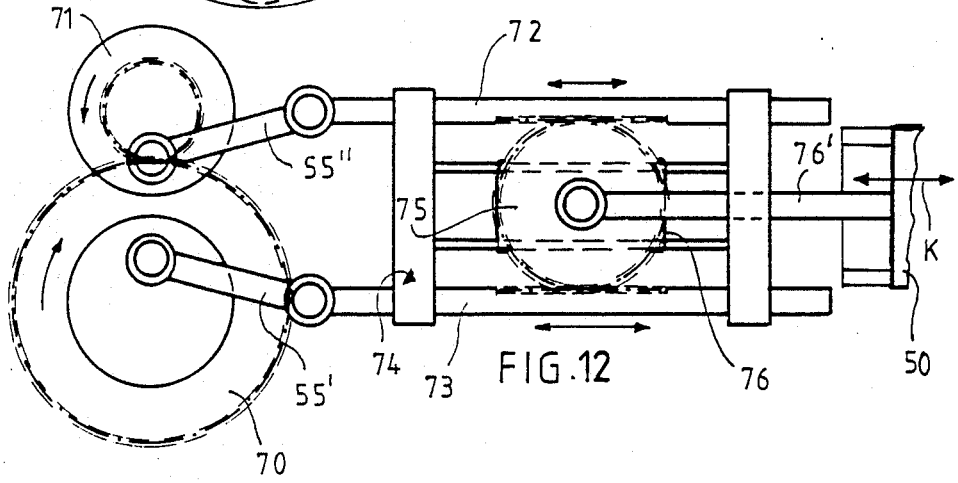
FIG. 12 is a top plan view of a twin crank gear which can take the place of the crank gear according to FIGS. 8 and 9.

The carriage 50 can be driven suitably in many cases also by a twin crank drive as is shown in the embodiment of FIG. 12. This twin crank drive has two gears 70,71 meshing with each other of different diameter. To each of these gears 70,71 the crank rods 55',55" are pivotally eccentrically mounted each rod to each gear.

The crank rods 55',55" are equally long in this embodiment and are pivotally attached with their other ends to toothed rods 72,73 which are mounted rigidly on the unshown frame 74 positioned on the coiler plate 11 and whose gear teeth mesh jointly with a gear 75 in position diametrically opposed to each other.

The gear 75 is movable back and forth by the oscillating motion of both toothed rods in the direction of the double arrow K and is pivotally mounted on a slidable member 76 guided linearly in the radial direction of the coiler plate. With the gear 75 the carriage 50 (of which only a short piece is seen) having the outlet sliver guide is attached to the shaft of the gear 75 by a linearly guided pivotally mounted connecting rod 76'.

One of both gears 70 or 71 is driven advantageously directly or by a step up gear or transmission gear by a shaft which can correspond to the shaft 56 of FIG. 10 which is driven by fixed gear teeth on a frame by the rotation of the coiler plate.

Particularly complicated motions of the outer sliver guide on rotation of the coiler plate can be produced by the twin crank drive according to FIG. 12, for example spiral shapes, snakelike motion paths or other motion paths which result in particularly good uniform deposition density for the sliver or roving.

In the embodiments above the spinning cans 13 rotate slowly about their longitudinal axis on coiling the sliver or roving in the cans. It is however also possible to have embodiments of our invention in which the spinning can performs another motion about its rotation axis in addition to its primary rotational motion which is a result of slowly moving its rotation axis around the longitudinal axis of the spinning can. For example on such motion of the coiler plate can entirely be provided by a corresponding motion of the frame 15 supporting the coiler plate 11 according to FIG. 5. Also in a way that has not been shown the maximum length of the superimposed oscillating motions of the outlet sliver guide 10 can be adjusted. This can for example in the embodiment according to FIGS. 1 and 2 occur by adjustment of the stroke of the guide drive 29 comprising a piston cylinder and in the embodiment according to FIGS. 8 and 9 by adjustment of the pivot point of the crank rod 55 on the gear 54.

It is of course understood that in the arrangement of gears in the coiler plate the outlet sliver guide can be driven as desired in motions other than linear motions, for example a disk corresponding to the disk 21 in FIGS. 1 and 2 ca be driven to generate the movement.

By definition a cam gear for the disk 21 and the outlet sliver guide includes the contacting roller 31, the cam 30 (i.e. the inner surface of the square plate 25) and the mounting rod 34. The catches 35 and the linear guide 32 are also included.

We claim:

1. In an apparatus for coiling sliver or roving in a spinning can, comprising a rotary coiler plate having an outlet sliver guide, the improvement wherein an oscillatory motion equalizing the deposition density of said sliver or roving is superimposed on a rotary motion of said outlet sliver guide of said coiler plate caused by rotation of said coiler plate.

2. The improvement according to claim 1 wherein said outlet sliver guide of said coiler plate is mounted so as to be movable with respect to said coiler plate and during said rotation of said coiler plate is driven in said oscillatory motion.

3. The improvement according to claim 2 wherein said outlet yarn guide piece is drivable in a swinging motion relative to said coiler plate.

4. The improvement according to claim 3 wherein said outlet sliver guide comprises a disk mounted on said coiler plate pivotable about a pivot axis parallel to the central pivot axis of said coiler plate.

5. The improvement according to claim 4 wherein said disk is pivotable by a cam gear whose cam is drivable in an oscillatory motion relative to said coiler plate.

6. The improvement according to claim 5 wherein said cam is a circular surface and is positioned adjacent a linear oscillating movable mounting rod and on said cam a contacting roller coupled with said disk is continuously pressed, said contacting roller being mounted on a linearly guided spring loaded mounting rod positioned on said coiler plate.

7. The improvement according to claim 2 wherein said outlet sliver guide is drivable in linearly guided oscillating motion relative to said coiler plate whose motion direction is effected approximately radially to the pivot axis of said coiler plate.

8. The improvement according to claim 7 wherein said outlet sliver guide is mounted on an oscillating linearly guided carriage.

9. The improvement according to claim 1 wherein said coiler plate is pivotally mounted on a supporting member driven in said oscillatory motion.

10. The improvement according to claim 9 wherein said supporting member has a supporting arm which is mounted to pivot about a pivot axis parallel to the pivot axis of said coiler plate.

11. The improvement according to claim 10 wherein a drive gear of a belt or chain drive for driving said coiler plate is mounted so as to pivot about the pivot axis of said supporting arm.

12. The improvement according to claim 9 wherein said supporting member is drivable in a linearly guided oscillating motion.

13. The improvement according to claim 1 wherein said oscillatory motion of said outlet sliver guide superimposed on said rotation of said coiler plate is effected by a separate guide drive which is either independent of the drive of said coiler plate or said drive of said coiler plate is in a constant predetermined operational connection therewith.

14. The improvement according to claim 1 wherein said oscillatory motion of said outlet sliver guide superimposed on said rotation of said coiler plate is effected by a gear unit driven by a gear unit drive or mounted on said coiler plate and driven by said rotation of said coiler plate.

15. The improvement according to claim 14 wherein said gear unit has a crank drive.

16. The improvement according to claim 14 wherein said gear unit has a rotary crank drive.

17. The improvement according to claim 14 wherein said gear unit has a twin crank drive.

18. The improvement according to claim 14 wherein said gear unit has a pinion which meshes with the fixed inner gear teeth of a supporting member in which said coiler plate is mounted.

19. The improvement according to claim 1 wherein said outlet sliver guide has an elongated recess in the bottom side of said coiler plate which extends in the rotation direction of said coiler plate and in whose front end region a sliver can be inserted from above through a passage.

20. An apparatus for coiling a sliver or roving in a spinning can comprising:

an approximately circular coiler plate mounted above said spinning can pivotable about an approximately centrally positioned pivot axis provided with a nonconcentric approximately circular opening;

a drive for rotation of said coiler plate in one direction;

an approximately circular outlet sliver guide comprising a disk positionable in said approximately circular opening of said coiler plate having an elongated recess on the bottom side of said disk which extends in the rotational direction of said coiler plate and a passage connecting said recess to the top side of said disk through which said sliver or roving can be fed, said disk being pivotally mounted about a pivot axis parallel to said centrally positioned pivot axis of said coiler plate;

a square plate slidably mounted on a rigid frame for said apparatus for said coiler plate provided with an approximately circular hole for said coiler plate;

a cam gear for providing an oscillating pivotal motion to said outlet sliver guide comprising a contacting roller positioned to engage the inner surface of said circular hole in said slidably mounted square plate rotatably mounted on a linear guided spring loaded mounting rod mounted on said coiler plate but engaging pivotally also said disk of said outlet sliver guide; and a guide drive comprising a piston cylinder for moving said square plate back and forth to provide said oscillating pivotal motion to said outlet sliver guide.

* * * * *